US005581333A

United States Patent [19]

Takemura et al.

[11] Patent Number: 5,581,333

[45] Date of Patent: Dec. 3, 1996

[54] ORIGINAL IMAGE FOCUSING APPARATUS HAVING POSITIONALLY ADJUSTABLE FOCUS LENS

[75] Inventors: Yukio Takemura, Kawasaki; Michiaki Endo, Yokohama, both of Japan

[73] Assignee: Canon Kabushiki Kaisha, Tokyo, Japan

[21] Appl. No.: 972,555

[22] Filed: Nov. 6, 1992

[30] Foreign Application Priority Data

Nov. 8, 1991 [JP] Japan ..... 3-293027

[51] Int. Cl.[6] ..... G03G 15/04

[52] U.S. Cl. ..... 355/243; 355/55

[58] Field of Search ..... 355/243, 55, 56, 355/57, 58, 235; 359/198, 200, 210, 694, 703, 809, 822, 823

[56] References Cited

U.S. PATENT DOCUMENTS

| | | | |
|---|---|---|---|
| 4,420,248 | 12/1983 | Ogawa et al. | 355/57 |
| 4,421,405 | 12/1983 | Nagahara | 355/58 |
| 4,429,353 | 1/1984 | Tokuhara et al. | 362/232 |
| 4,501,490 | 2/1985 | Miyamoto et al. | 355/55 |
| 4,521,100 | 6/1985 | Yonemori et al. | 355/243 |
| 4,639,121 | 1/1987 | Looney | 355/235 |
| 4,740,815 | 4/1988 | Tsuruoka | 355/233 |
| 4,998,135 | 3/1991 | Hyodo | 355/56 |
| 5,057,863 | 10/1991 | Yasuda | 355/57 |

*Primary Examiner*—Robert Beatty

*Attorney, Agent, or Firm*—Fitzpatrick, Cella, Harper & Scinto

[57] ABSTRACT

The present invention provides an original image focusing apparatus having a lens for focusing image light from an original on the photosensitive member, a first guide member for guiding a movement of the lens, a carriage on which the lens and the first guide member are mounted, and a second guide member for guiding movement of the carriage. The second guide member can be adjusted in a plurality of positions.

24 Claims, 7 Drawing Sheets

ORIGINAL IMAGE FOCUSING APPARATUS HAVING POSITIONALLY ADJUSTABLE FOCUS LENS

BACKGROUND OF THE INVENTION

1. Field of the Invention

The present invention relates to an original image focusing apparatus used in a copying machine and the like, and adapted to focus image light from an original on a photosensitive member. More particularly, it relates to an original image focusing apparatus wherein a focusing lens can be shifted in a first direction and a second direction independently.

2. Related Background Art

In the past, in order to copy an original image while properly registering an original with a recording sheet regardless of a resting reference position for the original and a stacking reference position for the recording sheets, a technique in which a lens is shifted in a direction perpendicular to an optical axis thereof, as well as a direction along the optical axis has been adopted to an analogue copying machine, as disclosed in U.S. Pat. No. 4,639,121 (Japanese Patent Appln. Laid-Open No. 61-295544).

However, in the above conventional apparatus, since the lens was shifted in both the optical axis direction and the direction perpendicular to the optical axis independently, it was difficult to properly position the posture of the lens with respect to the optical axis of the lens by merely incorporating the lens into the apparatus. Further, even when the lens was initially aligned with the optical axis, since the lens was widely shifted in two-dimensional directions, the lens was apt to be deviated from the optical axis, thus causing a problem regarding poor-alignment of the copied image, the fog in the image caused due to the beams of the image light reflected by elements in the apparatus, which results in the deterioration of the image.

SUMMARY OF THE INVENTION

An object of the present invention is to provide an original image focusing apparatus having a lens shifted in a first direction and a second direction independently, which can solve a problem regarding the deterioration of an image.

Another object of the present invention is to provide an original image focusing apparatus having a lens shifted in a first direction and a second direction independently, wherein the posture or position lens with respect to an optical axis of the lens can be adjusted in a simple manner.

The other object of the present invention will be apparent from the following descriptions.

DETAILED DESCRIPTION OF THE PREFERRED EMBODIMENTS

The present invention will now be explained in connection with embodiments thereof with reference to the accompanying drawings.

Figure 1:
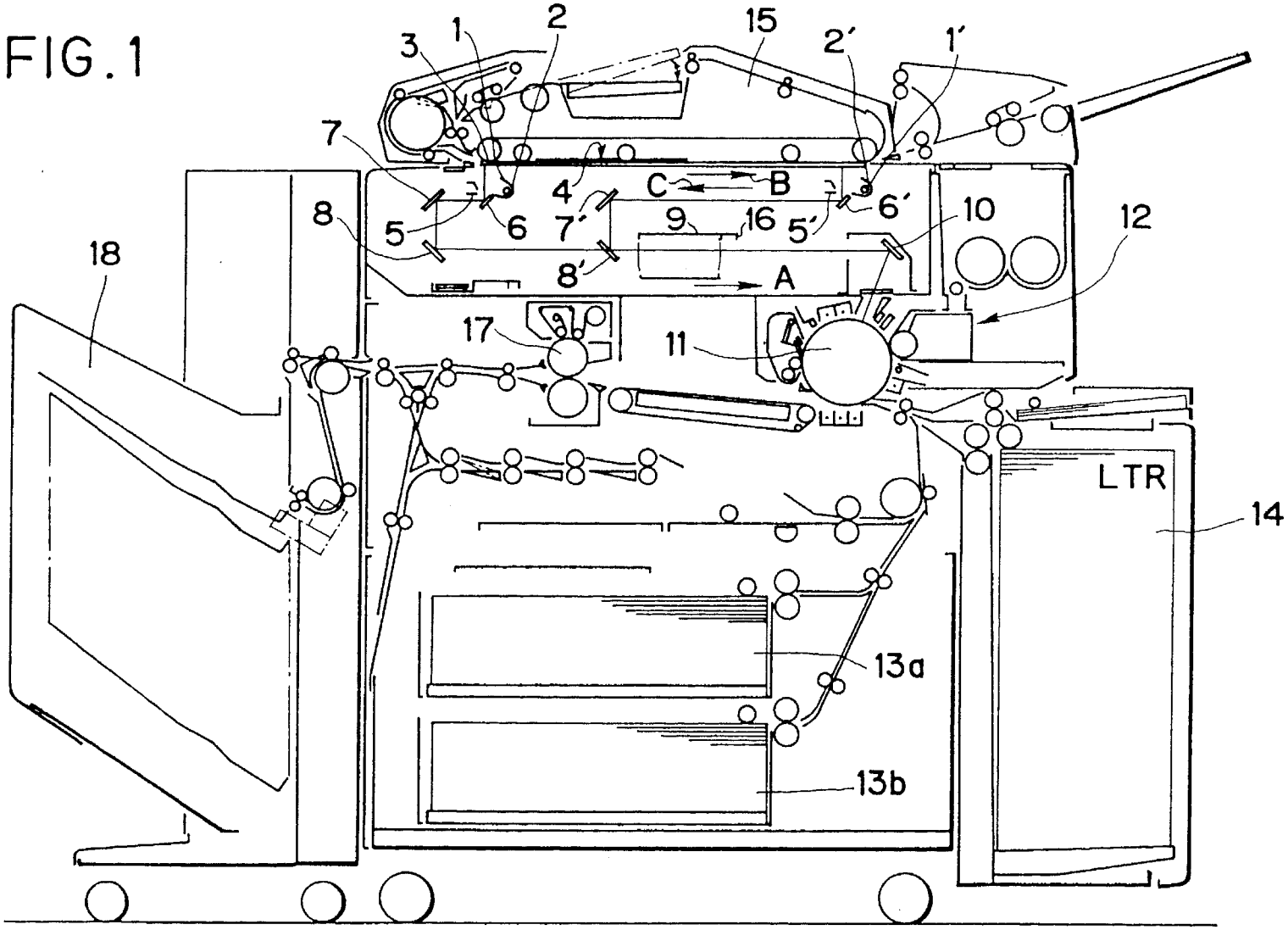
FIG. 1 is an elevational sectional view of a copying machine into which an original image focusing apparatus according to a preferred embodiment of the present invention is incorporated.

FIG. 1 is an elevational sectional view of a copying machine into which an original image focusing apparatus according to a preferred embodiment is incorporated. In FIG. 1, the reference numeral 1 denotes an elongated original illuminating halogen lamp; 2 denotes a reflection hood for reflecting light from the lamp 1 toward an original illumination portion; 3 denotes an original glass support on which an original 4 is rested; 5 denotes a slit member for regulating image light from the original; 6 denotes a first scanning mirror for scanning the original at a speed V together with the lamp 1 and the slit member 5 and for reflecting the image light from the original; 7 and 8 denote second and third mirrors moved at a speed of ½ V and adapted to reflect the image light from the first scanning mirror successively; and 9 denotes a zoom lens for focusing the image light from the original on a photosensitive member 11. The reference numeral 16 denotes a correction plate for correcting a light amount of the image light passed through the zoom lens 9; 10 denotes a fixed mirror for reflecting the image light passed through the zoom lens 9 onto the photosensitive member 11; 12 denotes an electrophotographic process means for performing the charging, developing, transferring and cleaning; 13*a*, 13*b* and 14 denote sheet supply cassettes; 15 denotes an automatic sheet original feeding device; 17 denotes a fixing device; and 18 denotes an ejecting portion.

In the illustrated embodiment, the zoom lens 9 is so designed that it can be shifted in a direction along an optical axis (i.e. optical axis direction) and a direction perpendicular to the optical axis independently, as will be fully described later.

Accordingly, in the illustrated embodiment, it is possible to copy the original image on a recording sheet while maintaining the proper registration therebetween even when the original is set at a "side reference" and the recording sheet is set at a "central reference". Incidentally, the "side reference" for the original indicates the fact that the original is set in such a manner as to coincide with one end of the original glass support in a direction perpendicular to a scanning direction of the original with a same position on the original glass support, and the "central reference" for the recording sheet indicates the fact that the recording sheet is set in such a manner that a central portion of the recording sheet in a direction perpendicular to a sheet feeding direction is always positioned at a same position.

Further, as mentioned above, since the zoom lens 9 can be shifted in the optical axis direction and the direction perpendicular to the optical axis independently, it is possible to shift the original image (to a direction perpendicular to the scanning direction) regardless of the change in the magnification rate of the image, thereby permitting the image treatment for forming an image at any position on the recording sheet even when the analogue copying machine is used.

Next, a copying sequence and operation steps of the copying machine according to the illustrated embodiment will be briefly described.

First of all, the original is set on the original glass support 3 or in the original feeding device 15, and the size of the recording sheet and, if necessary, the magnification rate of the image are selected. Then, a copy switch (not shown) is depressed.

When the copying operation is started, the zoom lens 9 is shifted to a position depending upon the size of the recording sheet and the magnification rate of the image, and is stopped there. At the same time when the lamp 1 is turned ON, the first, second and third scanning mirrors 6, 7, 8 are shifted from the left (in FIG. 1) toward a direction shown by the arrow B (i.e. to the right) below the original glass support 3, thus scanning the original successively. Light beams from the lamp 1 are reflected effectively by the reflection hood 2, thus illuminating the original 4 rested on the original glass support 3.

The reflected light from the illuminated surface of the original 4 passes through the original glass support 3 again and passes through an open portion of the slit member 5 to reach the first, second and third scanning mirrors 6, 7, 8 successively. Then, the light is reflected by these mirrors successively to reach the photosensitive member 11 through the focusing zoom lens 9 and the fixed mirror 10. When the lamp 1, reflection hood 2, slit member 5 and first scanning mirror 6 reach a final original reading end position (where these elements are denoted by the same reference numerals, but adding dash (')), the lamp, reflection hood, slit member and first to third scanning mirrors start to be shifted to a direction shown by the arrow C, thus returning to a position for the next copying operation.

The image information obtained on the photosensitive member 11 by scanning the under surface of the original glass support in the direction B is treated by the electrophotographic process means 12, thereby transferring a toner image corresponding to the image light onto a surface of the recording sheet. In this case, the recording sheet starts to be supplied in response to the scanning timing of the scanning mirrors, thereby being fed in registration with the electrophotographic process means. After, the transferring operation, the recording sheet is passed through the fixing device having a rotating fixing roller 17, where the transferred toner image is permanently fixed to the recording sheet. Thereafter, the recording sheet is ejected in the ejecting portion 18. In this way, the copying operation is finished.

Next, an optical system through which the image light from the original reaches the photosensitive member will be explained.

1. Original Illumination System

Figure 2:
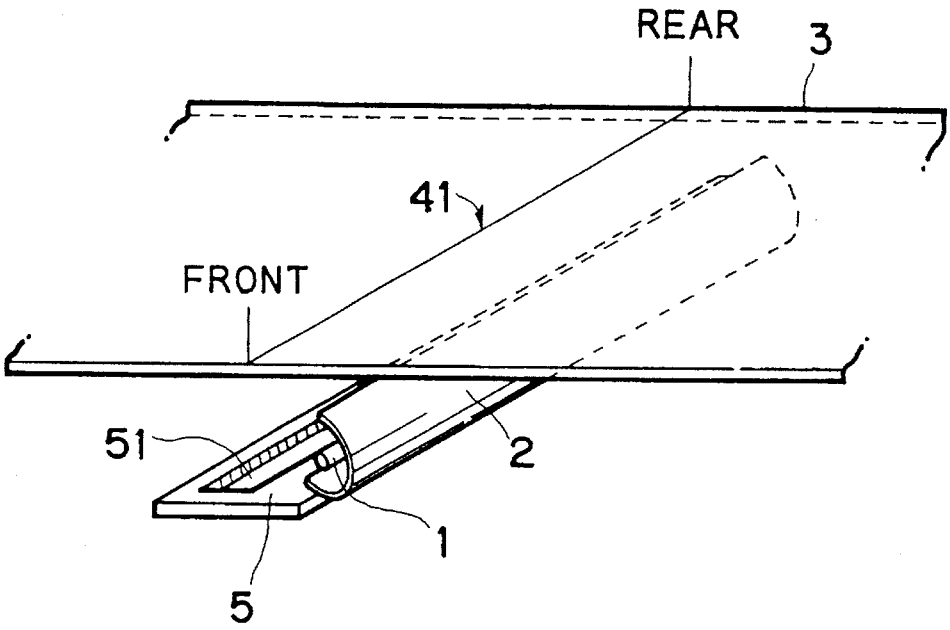
FIG. 2 is a perspective view of an illuminating system of the apparatus of FIG. 1.
Figure 3:
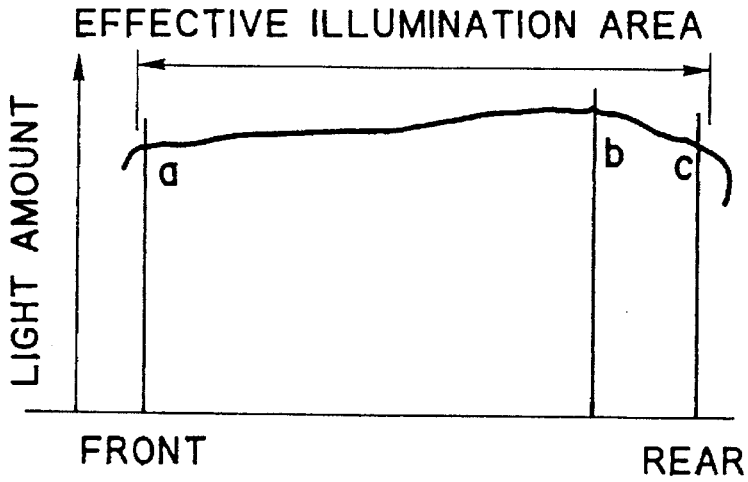
FIG. 3 is a view for explaining unevenness of a light amount at an original illumination portion.
Figure 4:
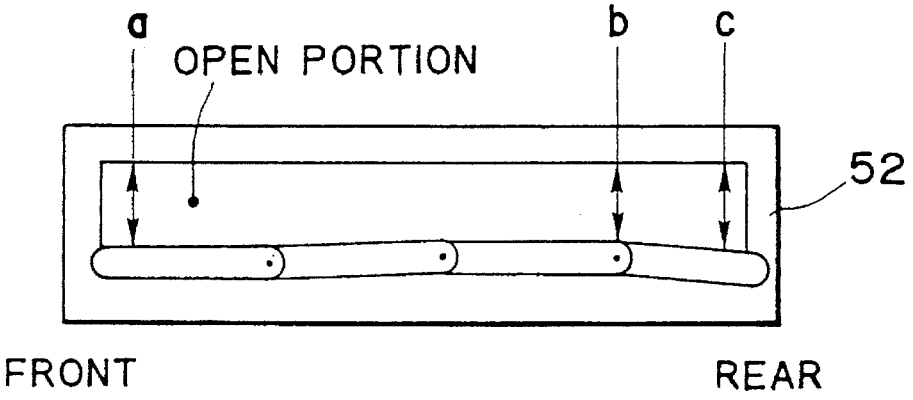
FIG. 4 is a side view of a slit member of the apparatus according to the embodiment of the present invention.

FIG. 2 is an enlarged schematic view of an original illumination system. A portion 41 from the front to the rear on the original glass support 3 and therearound are illuminated by the lamp 1 and the reflection hood 2. The light reflected from the original passes through an open portion 51 of the slit member 5 disposed substantially in a confronting relation to the original glass support 3 to be directed to the first scanning mirror 6 (FIG. 1). The distribution of an light amount on the original glass support is shown in FIG. 3. In FIG. 3, the abscissa indicates a dimension of a surface of the original from the front to the rear, and the ordinate indicates the light amount. An effective illumination area indicates a range to be copied. Even in such an effective illumination area, the distribution of the light amount on the original surface has the unevenness as shown, due to the dispersion and error in the manufacture of the lamp and the reflection hood. Thus, in the illustrated embodiment, a slit member 52 including an open portion having a variable width as shown in FIG. 4 is arranged below the original illumination portion so that the unevenness of light beams directing from a lower portion of the slit member to the first scanning mirror 6 can be corrected by changing the width of the open portion in correspondence to the unevenness of the light amount on the original surface. For example, the slit width at a position b in FIG. 4 corresponding to a position b in FIG. 3 where the light amount is great is decreased; whereas, the slit portion at a position a in FIG. 4 corresponding to a position a in FIG. 3 where the light amount is small is increased. This can be fully accomplished by providing appropriate means such as light amount sensors below the slit member.

Figure 5:
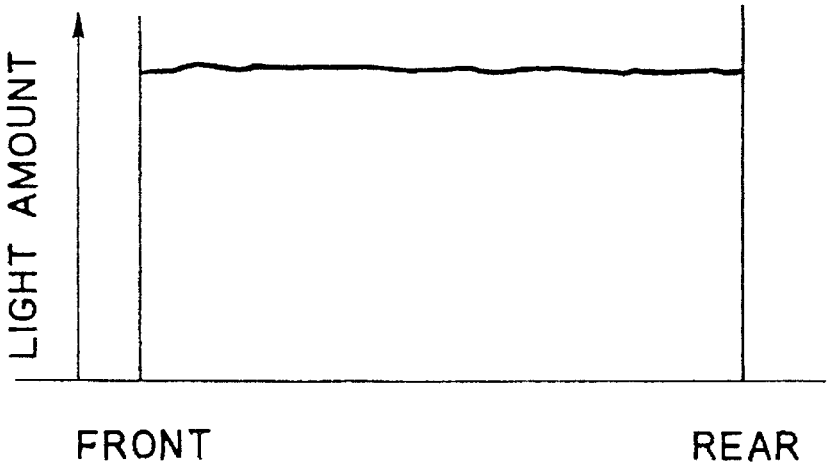
FIG. 5 is a view showing distribution of light amount generated when the slit member of FIG. 4 is used.

In this way the light beams directing from the slit member to the mirrors and the lens can be made even or uniform (without any unevenness) from the front to the rear, as shown in FIG. 5.

2. Optical System having Variable Magnification by Zoom Lens

In the embodiment shown in FIG. 1, the magnification rate can be varied by shifting the position of the zoom lens in the optical axis direction and by changing the focal length of the zoom lens. That is to say, the magnification rate is varied by shifting the position of the whole zoom lens and by shifting an inner lens in the zoom lens, while maintaining a distance from the original surface to the surface of the photosensitive member constant. In this way, according to the illustrated embodiment, since the length of the optical path including the zoom lens is not changed, when the magnification rate is desired to be varied, the mirrors such as the scanning mirrors disposed in the optical path are not required to be shifted, thus avoiding an additional complex mechanism and a large space. Incidentally, the unevenness in the light amount generated by the zoom lens can be corrected by a correction plate 16 (FIG. 1) fixed to the zoom lens 9.

3. Position Adjustment Means for Zoom Lens

Figure 6:
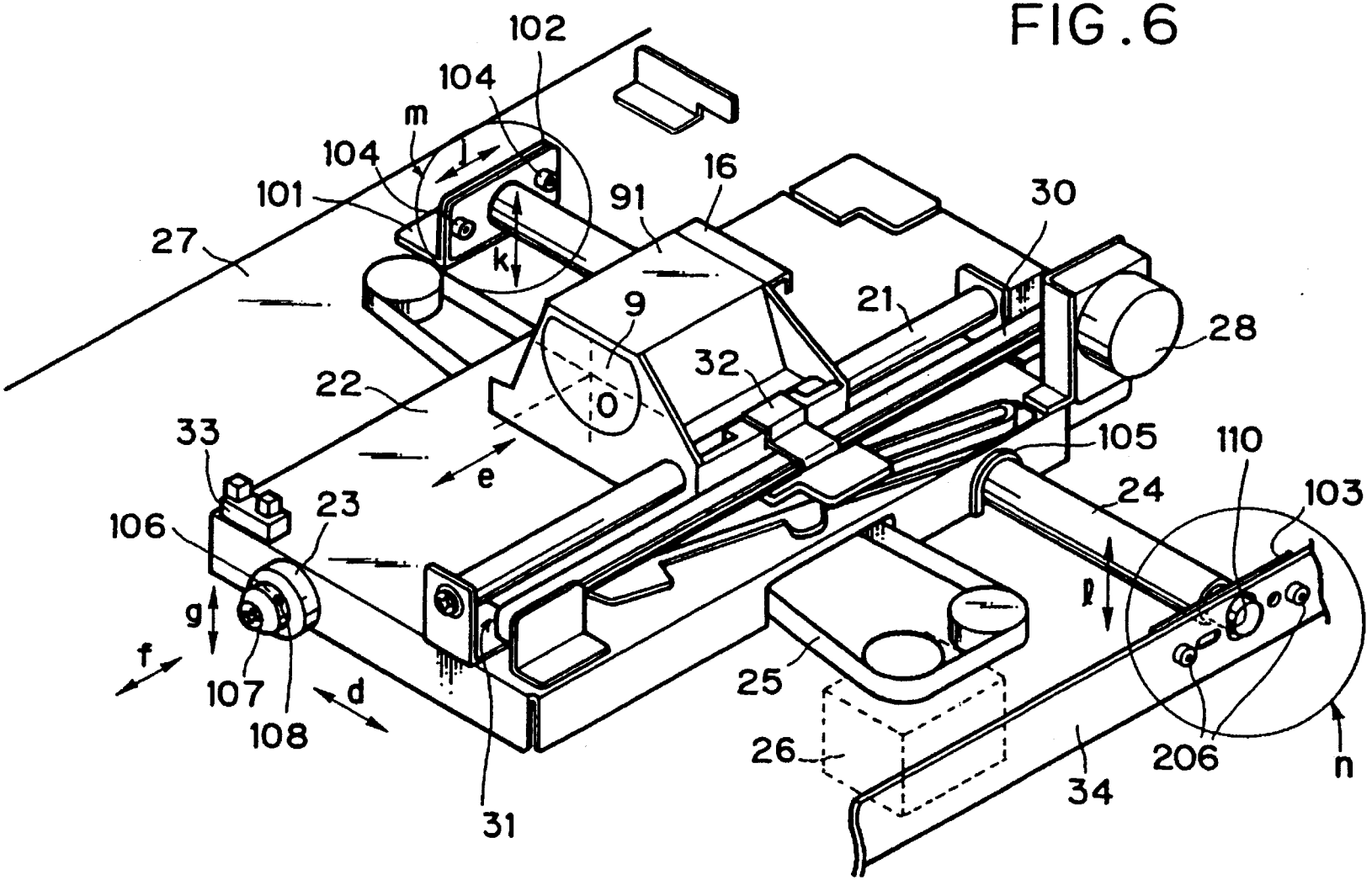
FIG. 6 is a perspective view of the focusing apparatus according to the embodiment of the present invention.

FIG. 6 is an enlarged schematic view of the original image focusing apparatus according to this embodiment, showing the zoom lens and therearound. The zoom lens 9 is housed in a lens mount 91 on which the correction plate 16 is secured. A lower end portion of the lens mount 91 is provided with an aperture through which a first guide rail 21 for guiding the zoom lens in the optical axis direction passes. The first rail 21 comprises a shaft having a circular cross-section and extending to a guiding direction straightly. A zoom belt 30 extends between a shaft of a zoom pulse motor 28 and a roller 31 (not visible in FIG. 6) in parallel with the first rail 21. Further, a portion of the belt 30 is secured to the lens mount by a belt holder 32. When the magnification rate is changed, the shaft of the zoom pulse motor 28 is rotated to shift the zoom belt 30, thereby shifting the lens mount 91 including the zoom lens 9 along the first rail 21 in directions shown by the arrow e. A shifting amount of the lens mount is controlled by the number of steps of the pulse motor detected by a photo-sensor 33.

The above-mentioned zoom lens 9, lens mount 91, first rail 21, pulse motor 28, zoom belt 30 and photo-sensor 33 are mounted on a lens carrier 22. The lens carrier 22 can be slid by a bearing 105 and a second rail 24 extending to a direction perpendicular to the optical axis (i.e., direction perpendicular to a length of the first rail 21) so that the carrier can be shifted and guided along the second rail 24. The second rail 24 comprises a shaft having a circular cross-section and extending to a guiding direction straightly. The lens carrier 22 can be pivoted around the second rail 24.

The lens carrier 22 and the second rail 24 are arranged on a lens support 27. Further, a pulse motor 26 is secured and positioned in front of the lens support 27. A belt 25 extends from a shaft of the pulse motor 26 to a pulley mounted on the lens support at a rear portion thereof. A portion (not visible in FIG. 6) of the belt 25 is secured to the lens carrier 22 so that the lens carrier can be shifted along the second rail 24 in a directions shown by the arrow d. A shifting amount of the lens carrier is controlled by the number of steps of the pulse motor detected by the photo-sensor. When the light beams from the original enters into the focusing apparatus from the direction f, if the zoom lens is in the left position in FIG. 6, the enlarged copy will be obtained. On the other hand, if the zoom lens is in the right position, the contracted copy will be obtained.

A roller 23 (rotary member) arranged at an end of the lens carrier 22 in the optical axis direction serves to regulate the height of the lens carrier 22 and can roll on the lens support when the lens carrier 22 is shifted in the directions d. The roller 23 has a rotation center varying in an up-and-down direction so that the deviation of the lens carrier 22 in the up-and-down direction can be adjusted by pivoting the lens carrier 22 around the second rail 24.

Figure 7:
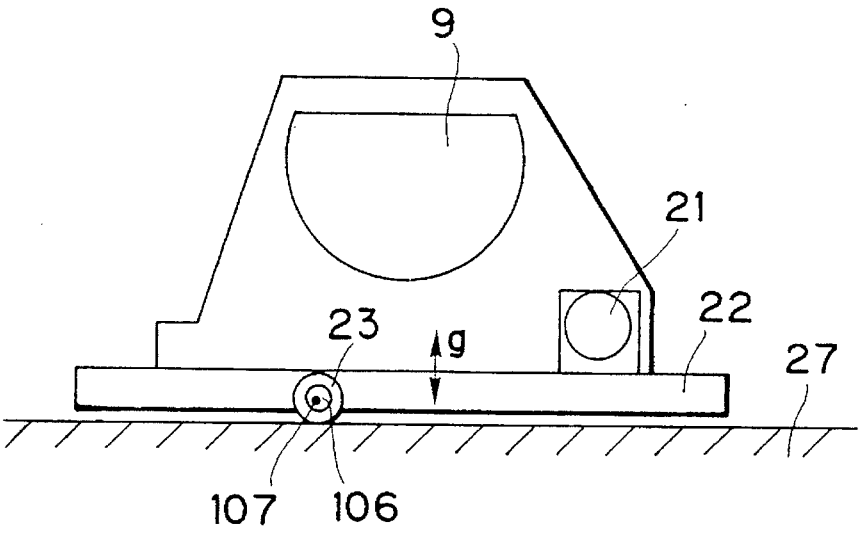
FIG. 7 is a schematic partial view of the focusing apparatus looked at from a direction shown by the arrow f in FIG. 6.

Now, a mechanism for moving the roller 23 in the up-and-down direction will be fully explained. Incidentally, FIG. 7 is a schematic elevational view of the carrier (looked at from the direction f ).

The roller 23 can roll around an eccentric shaft 106 which is rotatably mounted on the lens carrier by a stepped screw 107. Since the eccentric shaft 106 is eccentric around the stepped screw 107, when the eccentric shaft 106 is rotated, the roller 23 is rotated together with the eccentric shaft 106 around the stepped shaft 107, so that the height of the roller 23 is varied in accordance with the eccentric amount of the eccentric shaft 106 and the rotating amount of the eccentric shaft 106. Consequently, in the illustrated embodiment, it is possible to correct the deviation of he lens carrier 22 in the up-and-down direction, thus preventing deterioration of the image such as the poor alignment of the focused image and the unclear image.

Figure 8:
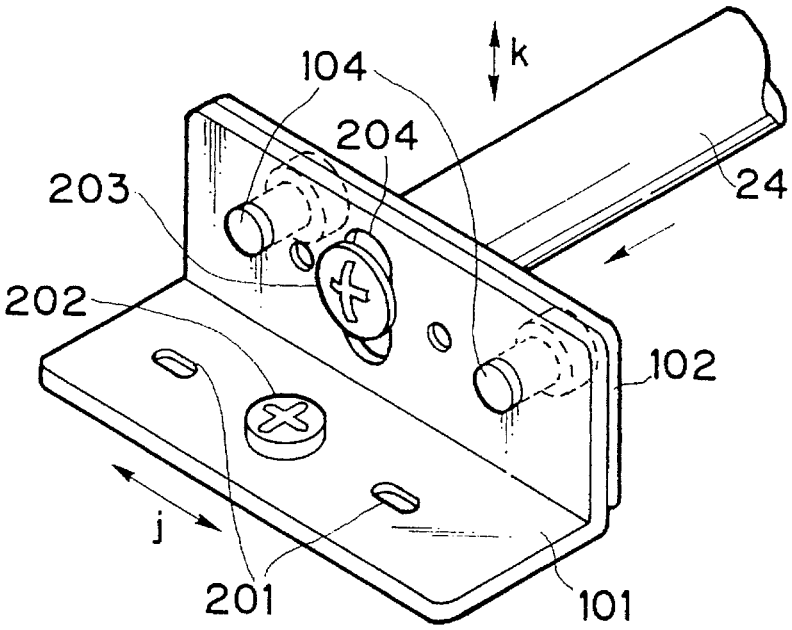
FIG. 8 is a perspective view of an adjustment mechanism provided at one end of a guide member of the apparatus according to the embodiment of the present invention.

Next, an attachment of ends (shown in FIG. 6 as m and n) of the second rail or shaft 24 will be explained. FIG. 8 is an enlarged view of a portion m shown in FIG. 6, FIG. 9 is an exploded perspective view of the portion of FIG. 8 before assembling, and FIG. 10 is an enlarged view of a portion n shown in FIG. 6.

In FIG. 8, one end of the shaft 24 is supported on a first support plate 101 provided on the lens support 27 via a height adjusting plate 102. This arrangement is further explained with reference to FIG. 9.

Figure 9:
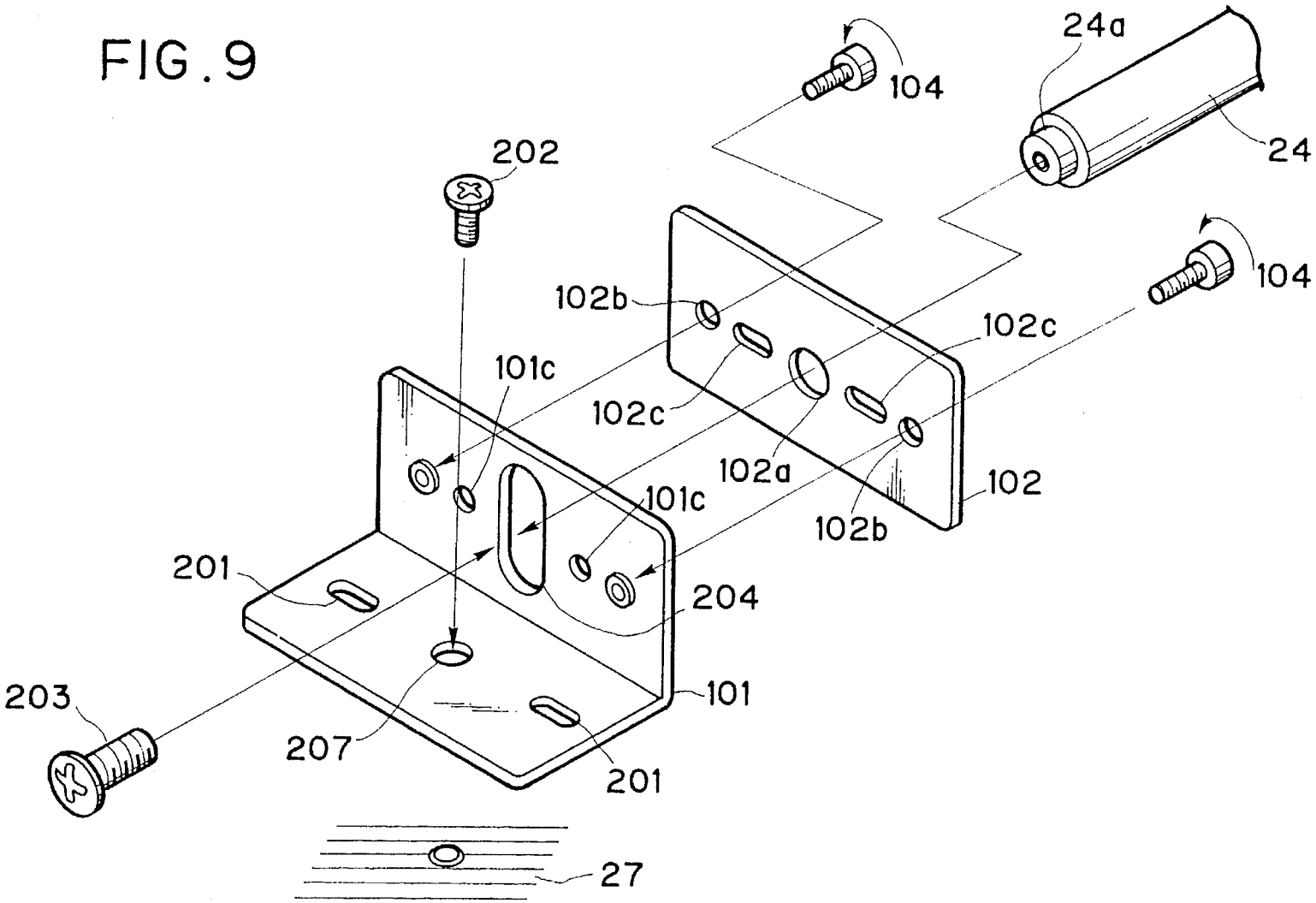
FIG. 9 is an exploded perspective view of the end of the guide member of FIG. 8.
Figure 10:
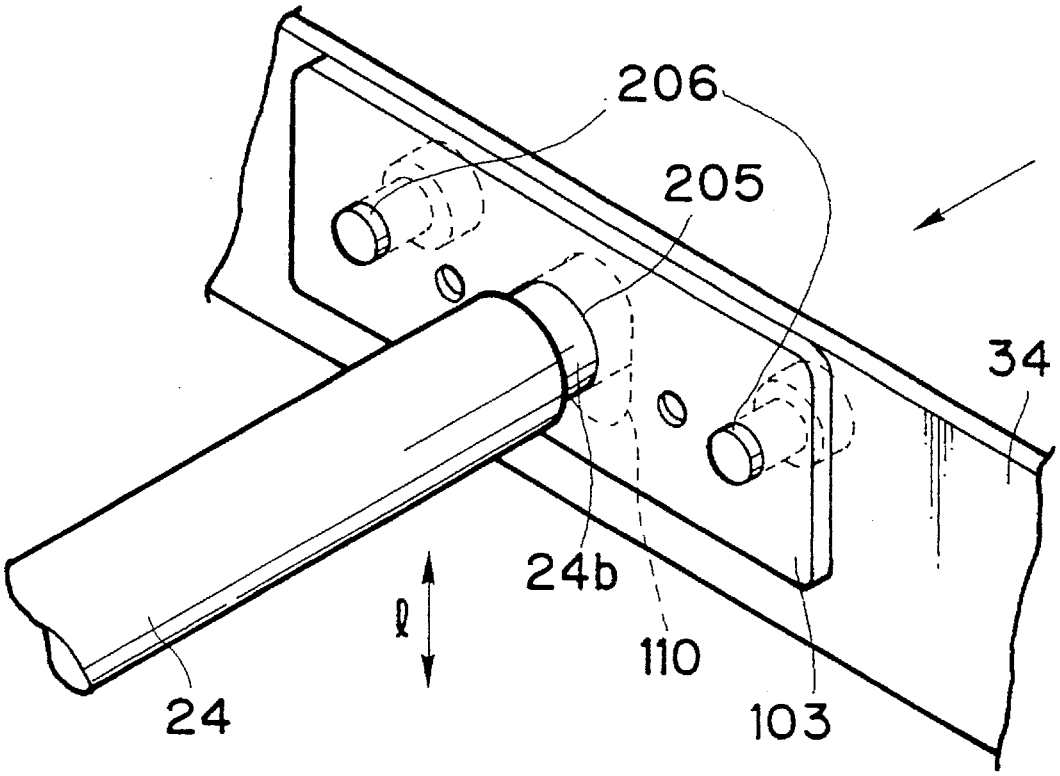
FIG. 10 is a perspective view of an adjustment mechanism provided at the other end of the guide member.

In FIG. 9, a stepped end 24*a* of the shaft 24 is fitted into a hole 102*a* formed in the height adjusting plate 102 to be positioned with respect to the height adjusting plate 102. The adjusting plate 102 is provided with positioning holes 102*c* and a support plate 101 is provided with corresponding positioning slots 101*c*. By inserting positioning pins into the positioning holes 102*c* and slots 101*c* of the adjusting plate 102 and support plate 101, the adjusting plate 102 is positioned with respect to the support plate 101. After such positioning, the adjusting plate 102 is secured to the support plate 101 by set screws 104 passing through holes 102*b* in the adjusting plate, and the shaft 24 is secured to the support plate 101 by a screw 203 via the adjusting plate 102. Incidentally, in this case, the stepped end 24*a* of the shaft 24 is fitted into an elongated slot 204 formed in the support plate 101.

Now, the elongated slot 204 of the support plate 101 extends in the up-and-down direction, and the holes 102*b* are so called baggy holes each having a diameter greater than a diameter of the set screw 104. Accordingly, by loosing the screws 203, 104, the end 24*a* of the shaft 24 can be shifted along the elongated slot 204 together with the adjusting plate 102, so that the position of the shaft 24 can be adjusted in the up-and-down direction. After the adjustment, by tightening the screws 203, 104 again, the end of the shaft 24 is fixed to the support plate 101 at the adjusted position. Incidentally, during the adjustment, the positioning pins are removed from the positioning holes 102*c* and slots 101*c*.

In this way, the end 24*a* of the shaft 24 can be adjusted in the up-and-down direction (directions shown by the arrow k in FIG. 6), so that the discrepancy of the zoom lens 9 around the first rail or shaft 21 can be corrected.

Next, a supporting mechanism for supporting the other end of the shaft 24, i.e., an end portion n shown in FIG. 6 will be explained with reference to FIG. 10.

In FIG. 10, a stepped end 24*b* of the shaft 24 is supported on a second support plate 34 constituting a rib on the lens support 27, via a height adjusting plate 103. The end 24*b* is fitted into a hole 205 formed in the height adjusting plate 103 to be positioned with respect to the height adjusting plate 103. Similar to the adjusting plate 102, by inserting positioning pins into positioning holes and slots of the adjusting plate 103 and support plate 34, the adjusting plate 103 is positioned with respect to the support plate 34. After such positioning, the adjusting plate 103 is secured to the support plate 34 by set screws 206. Incidentally, in this case, the stepped end 24*b* of the shaft 24 is fitted into an elongated slot 110 formed in the support plate 34. Now, the elongated slot 110 of the support plate 34 extends in the up-and-down direction, so that, similar to the adjusting plate 102, the adjusting plate 103 can be shifted in the up-and-down direction along the elongated slot 110 by loosing the screws 206.

In this way, the end 24*b* of the shaft 24 can be adjusted in the up-and-down direction (directions shown by the arrow l in FIG. 6), so that the discrepancy of the zoom lens 9 around the first rail or shaft 21 can also be corrected.

As mentioned above, since the both ends of the shaft 24 can be adjustingly shifted in the up-and-down direction, by shifting the both ends of the shaft by the same amounts, the height of the zoom lens 9 can be adjusted, and, by shifting the both ends of the shaft by different amounts, the inclined angle of the zoom lens can be adjusted.

Incidentally, the shaft 24 is secured to the support plate 101 by the screw 203 while being pulled toward the support plate 101 in the longitudinal direction of the shaft, and the other end of the shaft 24 near the support plate 34 is not secured to the support plate but is merely positioned by the adjusting plate 103. Further, the shaft 24 can be adjustingly shifted to directions shown by the arrow j in FIGS. 6 and 8. Such adjustment will be explained with reference to FIGS. 8 and 9.

As shown in FIGS. 8 and 9, the support plate 101 is secured to the lens support 27 by a screw 202. In this case, a hole 207 of the support plate 101 through which the screw 202 extends is a so-called baggy hole, and positioning slots 201 formed in the support plate 101 on both sides of the hole 207 extend in the optical axis direction.

That is to say, after the support plate 101 is positioned with respect to the lens support 27 by inserting positioning pins (not shown) into the positioning slots 201 of the support plate 101, the support plate 101 is secured to the lens support by tightening the screw 202. In this case, in a condition that the positioning pins are inserted into the positioning slots, when the screw 202 is loosened, the support plate 101 can be shifted in the direction j along the slots 201. After the support plate has been shifted to any position, it is secured to the lens support again by tightening the screw 202 again.

Accordingly, the end 24*a* of the shaft 24 can be adjustingly shifted with respect to a third axis perpendicular to both the shaft (first rail) 21 and the shaft (second rail) 24 to correct the discrepancy of the zoom lens 9.

In this way, the posture of the zoom lens 9 can be determined at three points, i.,e, roller 23 provided on the end of the lens carrier 22 and both ends 24*a*, 24*b* of the second rail 24, so that, by adjusting these points in the up-and-down direction, the height and the angular position of the zoom lens 9 can easily be adjusted.

Incidentally, in the illustrated embodiment, while the first rail mounted on the lens carrier was positioned in parallel with the optical axis and the second rail for guiding the lens carrier was positioned perpendicular to the optical axis, the rail mounted on the lens carrier may extend in the direction perpendicular to the optical axis and the rail for guiding the lens carrier may extend along the optical axis.

Further, in the illustrated embodiment, while the focusing lens was the zoom lens, a single-focus lens may be used as a focusing lens.

As mentioned above, although the present invention has been explained in connection with particular embodiments, the present invention is not limited to such embodiments, but various alterations and modifications can be effected within the scope of the present invention.

What is claimed is:

1. An original image focusing apparatus, comprising:

a lens for focusing image light from an original on a photosensitive member;

a first guide member for guiding movement of said lens;

a carriage on which said lens and said first guide member are mounted; and a second guide member for guiding movement of said carriage;

wherein said carriage comprises shift means for rotatingly shifting said carriage around said second guide member.

2. An original image focusing apparatus according to claim 1, wherein said shift means comprises a rotary member wherein the position of said rotary member can be varied in an up-and-down direction.

3. An original image focusing apparatus according to claim 1, wherein said lens comprises a zoom lens.

4. An original image focusing apparatus according to claim 1, wherein said first guide member is positioned perpendicular to said second guide member.

5. An original image focusing apparatus according to claim 4, wherein said first guide member is positioned in parallel with a direction of an optical axis of said lens.

6. An original image focusing apparatus, comprising:

a lens for focusing image light from an original on a photosensitive member;

a first guide member for guiding movement of said lens;

a carriage on which said lens and said first guide member are mounted;

a second guide member for guiding movement of said carriage;

a support member for supporting said second guide member; and positioning means for positioning said second guide member to said support member among a plurality of positions in an up-and-down direction.

7. An original image focusing apparatus according to claim 6, wherein said support member has a fitting hole which extends in the up-and-down direction and into which said second guide member is fitted.

8. An original image focusing apparatus according to claim 6, wherein said lens comprises a zoom lens.

9. An original image focusing apparatus according to claim 6, wherein said first guide member is positioned perpendicular to said second guide member.

10. An original image focusing apparatus according to claim 9, wherein said first guide member is positioned in parallel with a direction of an optical axis of said lens.

11. An original image focusing apparatus, comprising:

a lens for focusing image light from an original on a photosensitive member;

a first guide member for guiding movement of said lens;

a carriage on which said lens and said first guide member are mounted;

a second guide member for guiding movement of said carriage;

a support member for supporting said second guide member; and positioning means for positioning said second guide member to said support member among a plurality of positions in a direction of an optical axis of said lens.

12. An original image focusing apparatus according to claim 11, wherein said support member has a hole extending in the direction of the optical axis.

13. An original image focusing apparatus according to claim 11, wherein said lens comprises a zoom lens.

14. An original image focusing apparatus according to claim 11, wherein said first guide member is positioned perpendicular to said second guide member.

15. An original image focusing apparatus according to claim 14, wherein said first guide member is positioned in parallel with a direction of an optical axis of said lens.

16. An original image focusing apparatus, comprising:

a lens for focusing image light from an original on a photosensitive member;

a first guide member for guiding movement of said lens;

a second guide member for guiding movement of said lens in a direction perpendicular to said first guide member; and positioning means for positioning said lens around an optical axis, around said second guide member which is perpendicular to the optical axis, and around an axis perpendicular to both said optical axis and said second guide member.

17. An original image focusing apparatus according to claim 16, further comprising a carriage on which said lens and said first guide member are mounted, and wherein said second guide member guides a movement of said carriage.

18. An original image focusing apparatus according to claim 17, wherein a height and angular position of said lens is determined by three points comprising one end of said carriage and both ends of said second guide member.

19. An original image focusing apparatus according to claim 18, wherein said one end of said carriage can be shifted and adjusted in an up-and-down direction.

20. An original image focusing apparatus according to claim 18, wherein one end of said second guide member can be shifted and adjusted in an up-and-down direction and in the direction of the optical axis.

21. An original image focusing apparatus according to claim 16, wherein said lens comprises a zoom lens.

22. An original image focusing apparatus according to claim 16, wherein said first guide member is positioned perpendicular to said second guide member.

23. An original image focusing apparatus according to claim 22, wherein said first guide member is positioned in parallel with a direction of an optical axis of said lens.

24. An original image focusing apparatus according to claim 16, wherein said original image focusing apparatus is applied to a copying machine in which an original is set at a side reference and a recording sheet is set at a central reference.

* * * * *

UNITED STATES PATENT AND TRADEMARK OFFICE

CERTIFICATE OF CORRECTION

PATENT NO. : 5,581,333 Page 1 of 2

DATED : December 3, 1996

INVENTOR(S) : YUKIO TAKEMURA, et al.

It is certified that error appears in the above-indentified patent and that said Letters Patent is hereby corrected as shown below:

COLUMN 1:

Line 34, "poor-alignment" should read --poor alignment--.

COLUMN 3:

Line 62, "are" should read --is--.
Line 67, "an" should read --a--.

COLUMN 4:

Line 12, "directing" should read --being directed--.
Line 23, "directing" should read --being directed--.

UNITED STATES PATENT AND TRADEMARK OFFICE

CERTIFICATE OF CORRECTION

PATENT NO. : 5,581,333 Page 2 of 2

DATED : December 3, 1996

INVENTOR(S) : YUKIO TAKEMURA, et al.

It is certified that error appears in the above-indentified patent and that said Letters Patent is hereby corrected as shown below:

COLUMN 5:

Line 16, "a" should be deleted.
Line 19, "enters" should read --enter--.
Line 45, "he" should read --the--.

Signed and Sealed this

Sixth Day of May, 1997

*Attest:*

*Attesting Officer*

BRUCE LEHMAN

*Commissioner of Patents and Trademarks*